US008845089B2

(12) United States Patent
Akatsu et al.

(10) Patent No.: US 8,845,089 B2
(45) Date of Patent: Sep. 30, 2014

(54) MEDIUM LOADING DEVICE AND RECORDING APPARATUS FOR USE WITH ROLL PAPER

(71) Applicant: Seiko Epson Corporation, Tokyo (JP)

(72) Inventors: Shoji Akatsu, Shiojiri (JP); Akira Mashima, Azumino (JP); Tomoya Murotani, Matsumoto (JP); Yoshitaka Shimada, Matsummoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/780,896

(22) Filed: Feb. 28, 2013

(65) Prior Publication Data

US 2013/0271543 A1 Oct. 17, 2013

(30) Foreign Application Priority Data

Apr. 16, 2012 (JP) ..... 2012-092677

(51) Int. Cl.

| | |
|---|---|
| ***B41J 2/01*** | (2006.01) |
| ***B65H 16/06*** | (2006.01) |
| ***B41J 11/00*** | (2006.01) |
| ***B41J 15/04*** | (2006.01) |

(52) U.S. Cl.

CPC ..... *B41J 11/00* (2013.01); *B65H 16/06* (2013.01); *B41J 15/042* (2013.01)

USPC ..... 347/104; 242/596

(58) Field of Classification Search

CPC ..... B41J 11/00; B65H 16/06

USPC ..... 347/104; 242/611, 596.4, 596

See application file for complete search history.

(56) References Cited

U.S. PATENT DOCUMENTS

| | | | | |
|---|---|---|---|---|
| 5,332,169 | A * | 7/1994 | Harris et al. | 242/611 |
| 2008/0277851 | A1 | 11/2008 | Genta | |
| 2009/0212152 | A1 * | 8/2009 | Ozaki et al. | 242/596.4 |

FOREIGN PATENT DOCUMENTS

| | | | |
|---|---|---|---|
| JP | 10-291350 | A | 11/1998 |
| JP | 11-079492 | A | 3/1999 |
| JP | 2001-130792 | A | 5/2001 |
| JP | 2002-068537 | A | 3/2002 |
| JP | 2003-261248 | A | 9/2003 |
| JP | 2006-289696 | A | 10/2006 |
| JP | 2007-161382 | A | 6/2007 |
| JP | 2007-261086 | A | 10/2007 |
| JP | 2009-023171 | A | 2/2009 |
| JP | 2009023171 | * | 2/2009 |
| JP | 2009-202410 | A | 9/2009 |
| JP | 2009-226920 | A | 10/2009 |

* cited by examiner

*Primary Examiner* — Laura Martin
*Assistant Examiner* — Carlos A Martinez
(74) *Attorney, Agent, or Firm* — Nutter McClennen & Fish LLP; John J. Penny, Jr.; Joshua I. Rudawitz

(57) ABSTRACT

A medium loading device includes: a support unit having a shaft member that is attached to each of both end sections of roll paper and a flange member; a loading portion in which the roll paper with the support units attached thereto is loaded; a temporary placement portion on which the roll paper with the support units attached thereto is placed temporarily before being loaded into the loading portion; and a transfer path for transferring the roll paper with the support units attached thereto from the temporary placement portion to the loading portion. The flange member has in a region facing the transfer path a flat surface that is in contact with the transfer path.

10 Claims, 12 Drawing Sheets

MEDIUM LOADING DEVICE AND RECORDING APPARATUS FOR USE WITH ROLL PAPER

BACKGROUND

1. Technical Field

The present invention relates to a recording apparatus such as an ink jet type printer, and a medium loading device provided in the recording apparatus.

2. Related Art

Generally, as a kind of recording apparatus, an ink jet type printer is widely known. This kind of printer performs printing by supplying ink into a recording head and ejecting the supplied ink from a nozzle of the recording head toward a recording medium. Some printers of this kind use large-size roll paper as the recording medium (see, for example, JP-A-2009-23171).

In the printer according to JP-A-2009-23171, for preparation of printing, a roll assembly formed by integrating a roll of a long recording medium that is rolled into a roll, a pair of flanges attached to both end sections of the roll, and a spindle member inserted into the center of the roll is loaded into a loading portion.

In the printer according to JP-A-2009-23171, for loading the roll assembly into the loading portion, the roll assembly is temporarily placed on a temporary placement portion, and is subsequently moved by being rotated on a surface of a guide portion so that the roll assembly may be transferred to the loading portion. Thus, there is a problem that, when loading the roll assembly into the loading portion, the roll assembly may become unstable.

Similar problems may occur not only in the above-described ink jet type printer but also in all kinds of recording apparatuses that use a roll assembly.

SUMMARY

An advantage of some aspects of the invention is to provide a medium loading device and a recording apparatus which can stably transfer a roll medium that is placed on a temporary placement portion to a loading portion.

A medium loading device according to an aspect of the invention includes: a support unit having a medium holder that is attached to each of both end sections of a roll medium obtained by rolling a long medium in a roll so that the medium holder is rotatable together with the roll medium, and a medium supporter that supports the medium holder rotatably; a loading portion in which the roll medium with the support units attached thereto is loaded; a temporary placement portion on which the roll medium with the support units attached thereto is placed temporarily before being loaded into the loading portion; and a transfer path for transferring the roll medium with the support units attached thereto from the temporary placement portion to the loading portion. In the medium loading device, the medium supporter has in a region facing the transfer path a contact portion that is in contact with the transfer path, and the contact portion has a first contact point at which the contact portion is in contact with the transfer path and which is closest to the loading portion and a second contact point at which the contact portion is in contact with the transfer path and which is closest to the temporary placement portion. The first contact point and the second contact point may be disposed at a distance from each other in the transfer direction of the roll medium from the temporary placement portion to the loading portion.

According to the aspect, since the contact portion is structured so that the first contact point and the second contact point may be disposed away from each other at the distance mentioned above, the roll medium is not rotated when the roll medium with the support units attached thereto is transferred from the temporary placement portion to the loading portion via the transfer path. Thus, the roll medium that is placed on the temporary placement portion may be transferred stably to the loading portion.

In the medium loading device according to the aspect, the temporary placement portion may be horizontal, the loading portion may be positioned lower than the temporary placement portion, and the transfer path may slope.

In this case, the roll medium with the support units attached thereto may be placed stably on the temporary placement portion, and thereafter, the roll medium with the support units attached thereto may be transferred from the temporary placement portion to the loading portion via the transfer path by gravity.

In the medium loading device according to the aspect, a center of gravity of the roll medium may be positioned between the first contact point and the second contact point.

In this case, the roll medium may be supported stably by the support units.

In the medium loading device according to the aspect, the distance between the first contact point and the second contact point may be larger than the outer diameter of the roll medium.

In this case, the roll medium may be supported more stably by the support units.

In the medium loading device according to the aspect, the transfer path may be provided with a shock applier that applies a shock to the support unit when the roll medium with the support units attached thereto is transferred to the loading portion.

In this case, when the roll medium with the support units attached thereto is transferred to the loading portion by a user, a shock is applied to the support unit by the shock applier. Thus, by making the user feel this shock, the user may recognize that the roll medium with the support units attached thereto has been loaded into the loading portion.

A recording apparatus according to an aspect of the invention includes: the medium loading device with any of the above-described structures; and a recorder that performs recording processing on the roll medium which is drawn out from the medium loading device.

According to the aspect of the invention, effects similar to those of the above-described medium loading device may be obtained.

BRIEF DESCRIPTION OF THE DRAWINGS

The invention will be described with reference to the accompanying drawings, wherein like numbers reference like elements.

DESCRIPTION OF EXEMPLARY EMBODIMENTS

An embodiment in which the recording apparatus according to an aspect of the invention is embodied in an ink jet type printer will be described with reference to the accompanying drawings.

Figure 1:
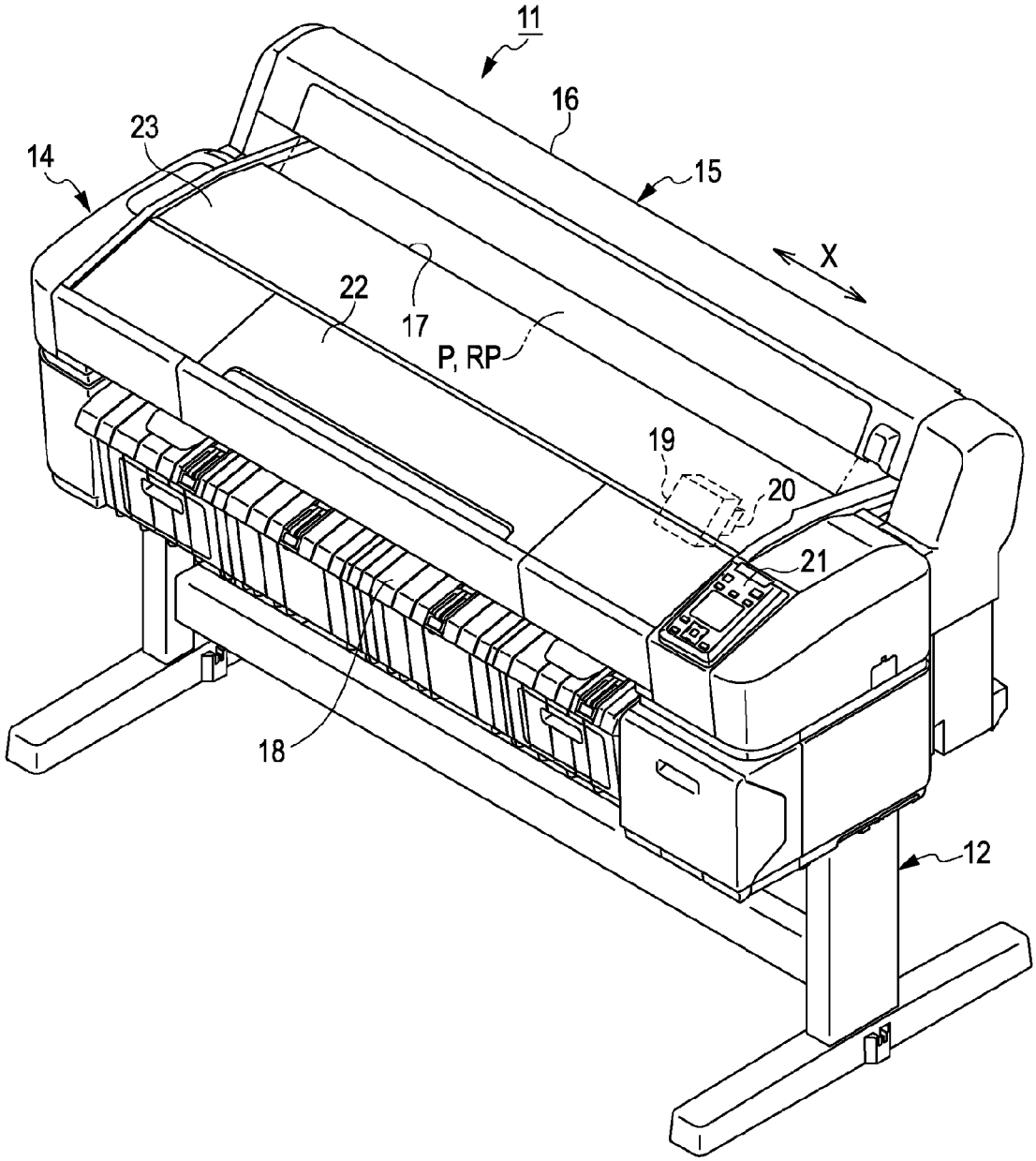
FIG. 1 is a perspective view of an ink jet type printer according to an embodiment.

As illustrated in FIG. 1, an ink jet type printer 11 as the recording apparatus is supported on a pedestal 12. The ink jet type printer 11 includes a substantially rectangular parallelepiped-shaped main body 14 and a paper feeder 15 which protrudes obliquely backward and upward from a rear section of the main body 14 and which loads roll paper RP that is a roll medium obtained by rolling paper P as a long medium into a roll.

On a top section of the paper feeder 15, a flip-up access cover 16 is provided. In addition, at a boundary position between a lower end section of the paper feeder 15 and the main body 14, a paper feeding slot 17 for feeding the paper P into the main body 14 is formed. The paper P is unwound and drawn out from the roll paper RP loaded in the paper feeder 15. In the main body 14, a transport mechanism which is not illustrated in the figures is provided. The transport mechanism transports the paper P that is fed from the paper feeding slot 17 along its transport path to a paper ejecting slot 18 that is formed in a front section of the main body 14.

In the main body 14, at a position facing the transport path of the paper P, a carriage 19 is provided to reciprocate in a width direction of the paper P which is perpendicular to the transport direction of the paper P. In the carriage 19, at a position facing the transport path of the paper P, a recording head 20 as a recorder is supported. The recording head 20 performs printing as recording processing by ejecting ink from a nozzle (not illustrated in the figures) onto the paper P that is transported on the transport path, while the recording head 20 reciprocates together with the carriage 19 in a scanning direction X that is a longitudinal direction of the main body 14 or a width direction of the roll paper RP which is perpendicular to the transport direction of the paper P. In addition, an operation panel 21 with which the user performs various setting operations, various information inputting operations and the like is provided on, for example, an upper right end section of the main body 14.

In the middle of a front side of an upper section of the main body 14 in the scanning direction X, a maintenance cover 22 that allows access to the inside of the main body 14 for maintenance is provided so that the maintenance cover 22 can be openable and closable. On the other hand, on half of the top section of the main body 14 on the paper feeder 15 side (on a rear side that is opposite to the front side), a rectangular top plate 23 is provided.

Figure 2:
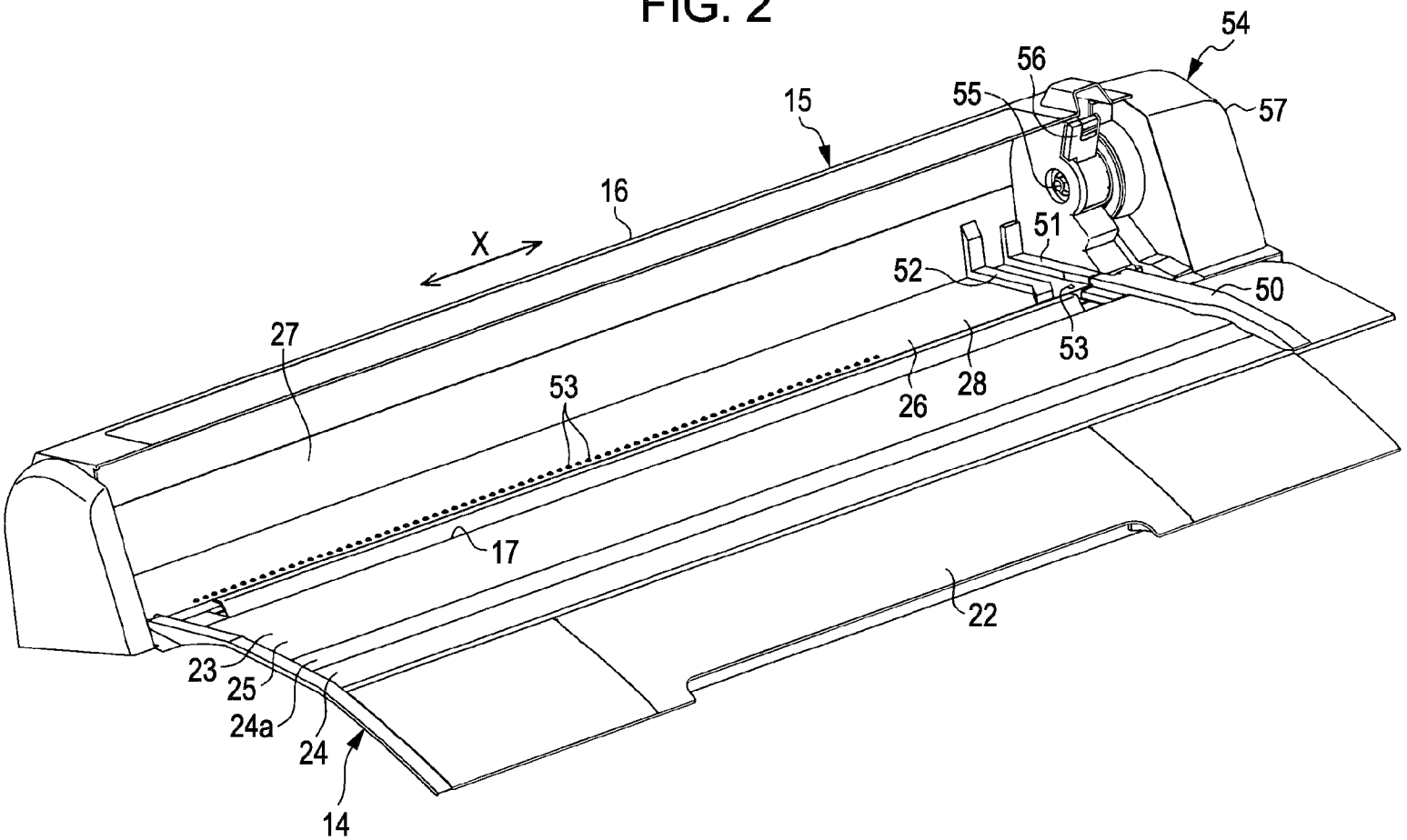
FIG. 2 is a perspective view illustrating a main portion of the printer.

As illustrated in FIG. 2, the top plate 23 includes a horizontal temporary placement portion 24 on which the roll paper RP (see FIG. 8) is temporarily placed before being loaded into the paper feeder 15, and an inclined portion 25 that slopes down from the temporary placement portion 24 to the paper feeder 15. On the temporary placement portion 24, a positioning concave portion 24*a* is formed extending in the scanning direction X. The positioning concave portion 24*a* is provided for determining the position of the roll paper RP (see FIG. 8) by suppressing rotation of the roll paper RP, when the roll paper RP is placed temporarily.

On a bottom section of the paper feeder 15, a rectangular bottom plate 26 that is parallel to the inclined portion 25 is provided. In this case, the paper feeding slot 17 is positioned between the bottom plate 26 and the inclined portion 25. On an end section of the bottom plate 26 on an opposite side of the paper feeding slot 17, a rectangular back-side plate 27 is provided so as to stand vertically on the bottom plate 26. A region above the bottom plate 26 is a loading portion 28 in which the roll paper RP (see FIG. 8) is to be loaded. Accordingly, the loading portion 28 is positioned lower than the temporary placement portion 24.

Figure 3:
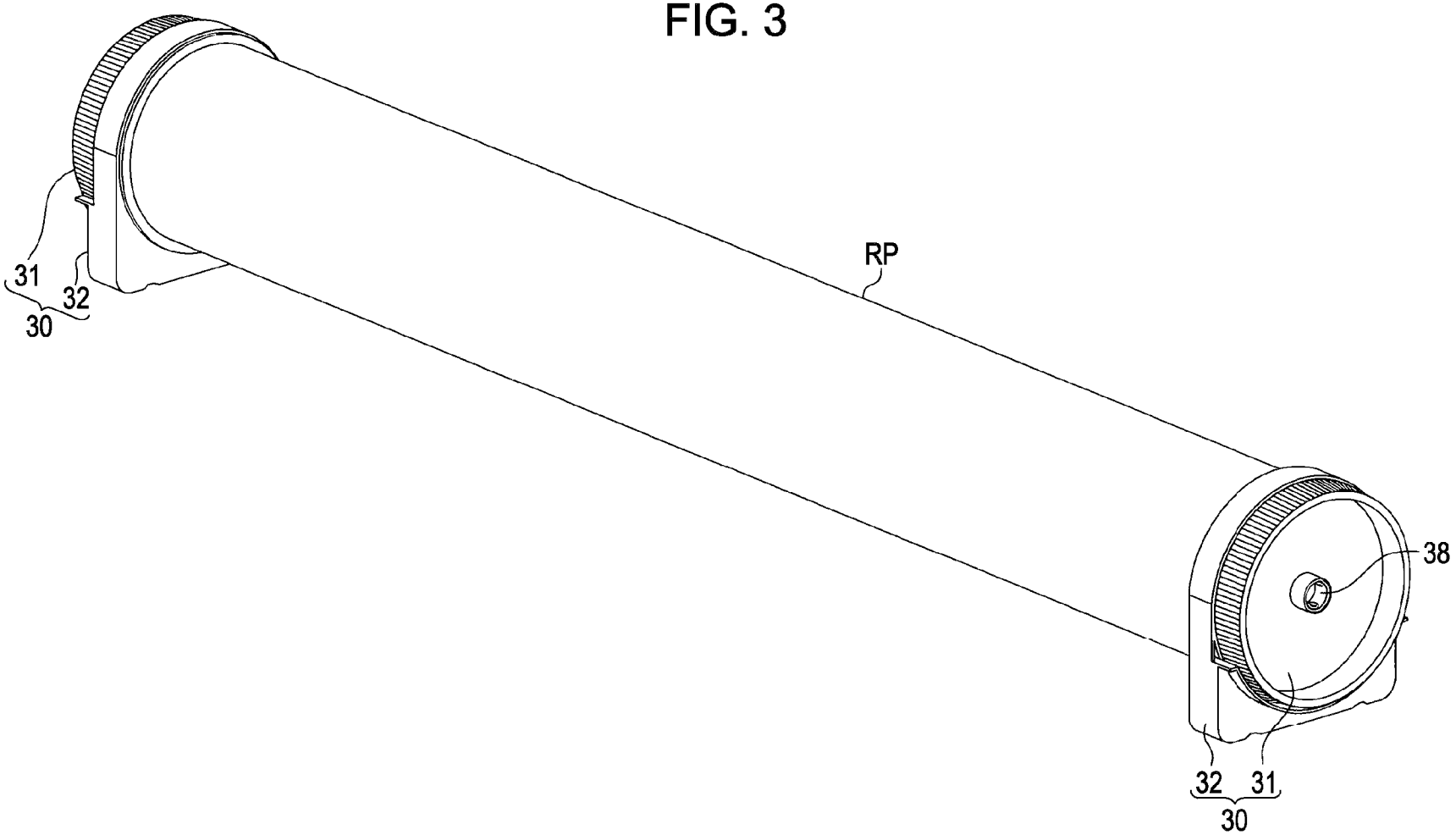
FIG. 3 is a perspective view of roll paper with support units attached thereto.

As illustrated in FIG. 2 and FIG. 3, in the case of loading the roll paper RP into the loading portion 28, support units 30 that support the roll paper RP rotatably are attached to both end sections of the roll paper RP. That is, the support unit 30 includes a shaft member 31 as a medium holder which holds the roll paper RP rotatably together with the shaft member 31, and a flange member 32 as a medium supporter which supports the shaft member 31 rotatably.

Figure 4:
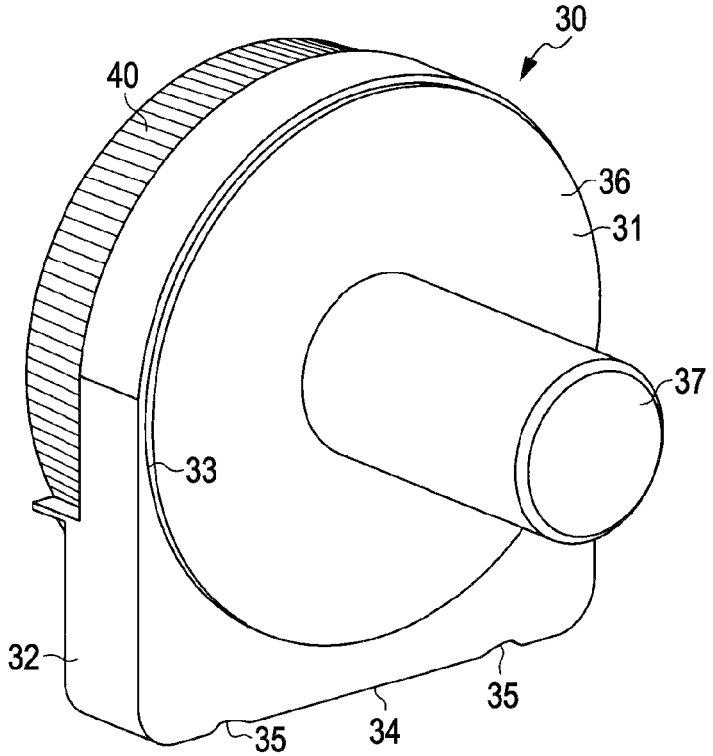
FIG. 4 is a perspective view of the support unit.
Figure 5:
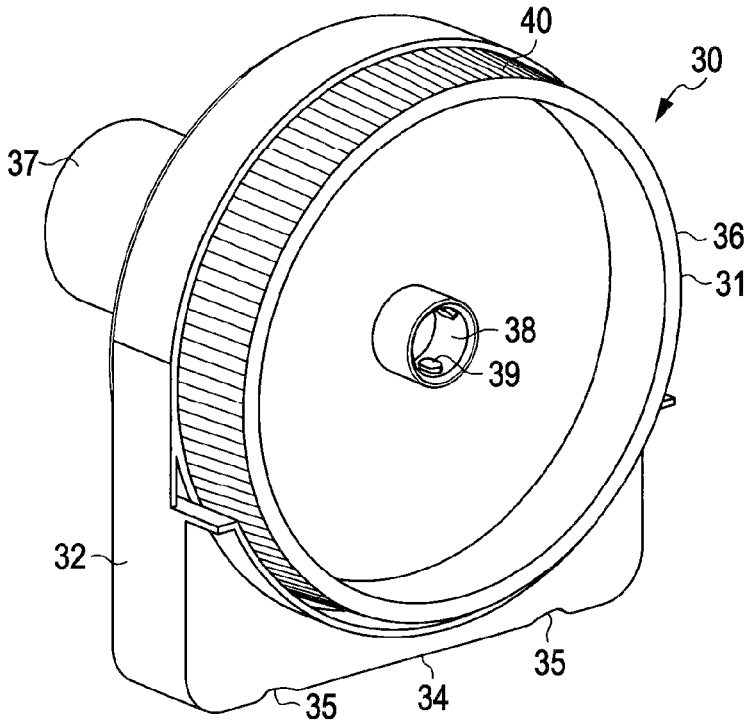
FIG. 5 is a perspective view of the support unit.

As illustrated in FIG. 4 and FIG. 5, the flange member 32 in the support unit 30 is semicircular in its upper half, and is substantially rectangular in its lower half. That is, the flange member 32 is substantially D-shaped on the whole. A circular support hole 33 is formed along an outer periphery of the semicircular section of the flange member 32 so as to penetrate the flange member 32.

Moreover, the bottom surface of the flange member 32 is a flat surface 34 serving as a flat contact portion which is substantially rectangular. A pair of concave grooves 35 are formed on the flat surface 34. The concave grooves 35 respectively extend in a short-side direction of the flat surface 34, and are disposed at a distance from each other in a longitudinal direction of the flat surface 34.

The shaft member 31 includes a substantially disk-shaped rotating portion 36, a columnar shaft portion 37 that projects from a center section of one lateral surface of the rotating portion 36 and is fitted into a center hole H (see FIG. 8) of the roll paper RP, and a circular shaft hole 38 that is formed in a center section of the other lateral surface of the rotating portion 36 (a surface of the rotating portion 36 on an opposite side of the shaft portion 37). On an inner peripheral surface of the shaft hole 38, plural engagement pieces 39 are formed at constant intervals in a circumferential direction.

The outer diameter of the rotating portion 36 is set to be slightly larger than the maximum outer diameter of the roll paper RP. A half of the rotating portion 36 on the shaft portion 37 side is rotatably inserted into the support hole 33 of the flange member 32, and the other half of the rotating portion 36 on the opposite side of the shaft portion 37 is exposed. On the peripheral surface of the exposed part of the rotating portion 36 which is exposed from the support hole 33, a large number of ribs 40 that function as slip resistance members when the user rotates the shaft member 31 manually are formed at regular intervals in the circumferential direction.

Figure 6:
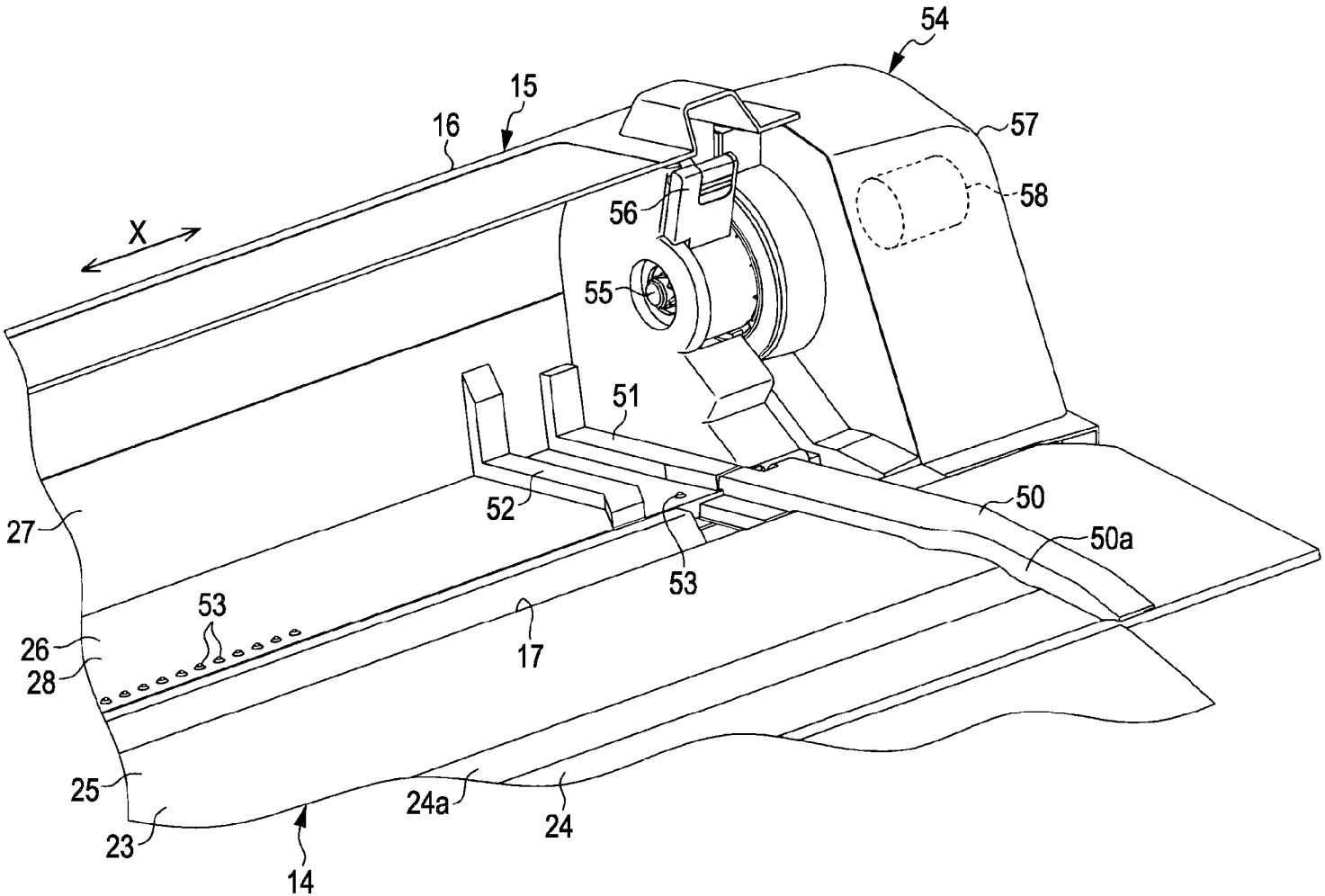
FIG. 6 is an enlarged perspective view illustrating a main portion of FIG. 2.

As illustrated in FIG. 6, on one end section (a right end section in FIG. 6) of the top plate 23 of the main body 14 in the scanning direction X, a first guide member 50 extending in a direction perpendicular to the scanning direction X (a front-back direction in FIG. 6) is provided. On a surface of the first guide member 50 on the temporary placement portion 24 side, a clearance 50*a* is formed in a part corresponding to the temporary placement portion 24 so that the first guide member 50 has a reduced width in the scanning direction X at the part, as compared to the width of the remaining part of the surface of the first guide member 50.

In addition, on one end section (a right end section in FIG. 6) of the bottom plate 26 of the paper feeder 15 in the scanning direction X, a second guide member 51 extending in a direction perpendicular to the scanning direction X (the front-back direction in FIG. 6) is provided. One end (a front end in FIG. 6) of the second guide member 51 is in contact with the first guide member 50, and the other end (a back end in FIG. 6) of the second guide member 51 is bent vertically upward and extends along the back-side plate 27.

In this case, the second guide member 51 is in contact with the first guide member 50 so that their corresponding surfaces may be substantially flush with each other. In addition, a tip of the bent part of the second guide member 51 reaches around a half of the height of the back-side plate 27.

Further, on the bottom plate 26, a third guide member 52 that extends in parallel with the second guide member 51 is provided. Similarly to the second guide member 51, one end section of the third guide member 52 on an opposite side of the top plate 23 is bent vertically upward and extends along the back-side plate 27. In this case, the distance between the second guide member 51 and the third guide member 52 is set to be slightly larger than the thickness of the flange member 32 (see FIG. 4).

Thus, when the roll paper RP (see FIG. 3) with the support units 30 attached thereto is loaded into the loading portion 28, the flange member 32 in the support unit 30 is capable of being inserted between the second guide member 51 and the third guide member 52. In addition, an end section of the third guide member 52 on the top plate 23 side is bent at an angle of about 30 degrees toward an opposite side of the second guide member 51 so that the flange member 32 may be easily inserted between the second guide member 51 and the third guide member 52 from the top plate 23 side.

On the bottom plate 26, one protrusion 53 is provided at an end section on the top plate 23 side between the second guide member 51 and the third guide member 52. Further, on an end section of the bottom plate 26 on the top plate 23 side, plural protrusions 53 are provided at regular intervals in a region between a position at a predetermined distance (a minimum width of the roll paper RP, that is, about 10 cm) from the third guide member 52 to the opposite side of the second guide member 51, and an end section of the bottom plate 26 on the opposite side of the second guide member 51.

Each protrusion 53 is set so that a height thereof may be slightly smaller than the depth of each concave groove 35 (see FIG. 4) of the flange member 32, and the outer diameter of each protrusion 53 may be slightly smaller than the width of each concave groove 35 of the flange member 32. Thus, the protrusions 53 can fit into the concave grooves 35 with a play.

In the paper feeder 15, at a position facing the third guide member 52 across the second guide member 51 (a right end section of the paper feeder 15 in FIG. 6), a rotating power applying unit 54 is provided. The rotating power applying unit 54 applies rotating power to the roll paper RP via the shaft member 31 (see FIG. 3), when the roll paper RP (see FIG. 3) with the support units 30 attached thereto is loaded into the loading portion 28.

The rotating power applying unit 54 includes a rotating shaft 55 that is structured to be movable in the scanning direction X so as to be freely inserted into/withdrawn from the loading portion 28, an operation lever 56 for operating the rotating shaft 55 to protrude to/withdraw from the loading portion 28, and the motor 58 that is disposed in a motor case 57 and drives the rotating shaft 55 to be rotated.

When flipping up the operation lever 56, the rotating shaft 55 is moved in the scanning direction X to a withdrawn position (a position illustrated in FIG. 6) where the rotating shaft 55 is withdrawn from the loading portion 28 side. When flipping down the operation lever 56, the rotating shaft 55 is moved in the scanning direction X to a protruding position (a position illustrated in FIG. 7) where the rotating shaft 55 protrudes toward the loading portion 28 side.

Figure 7:
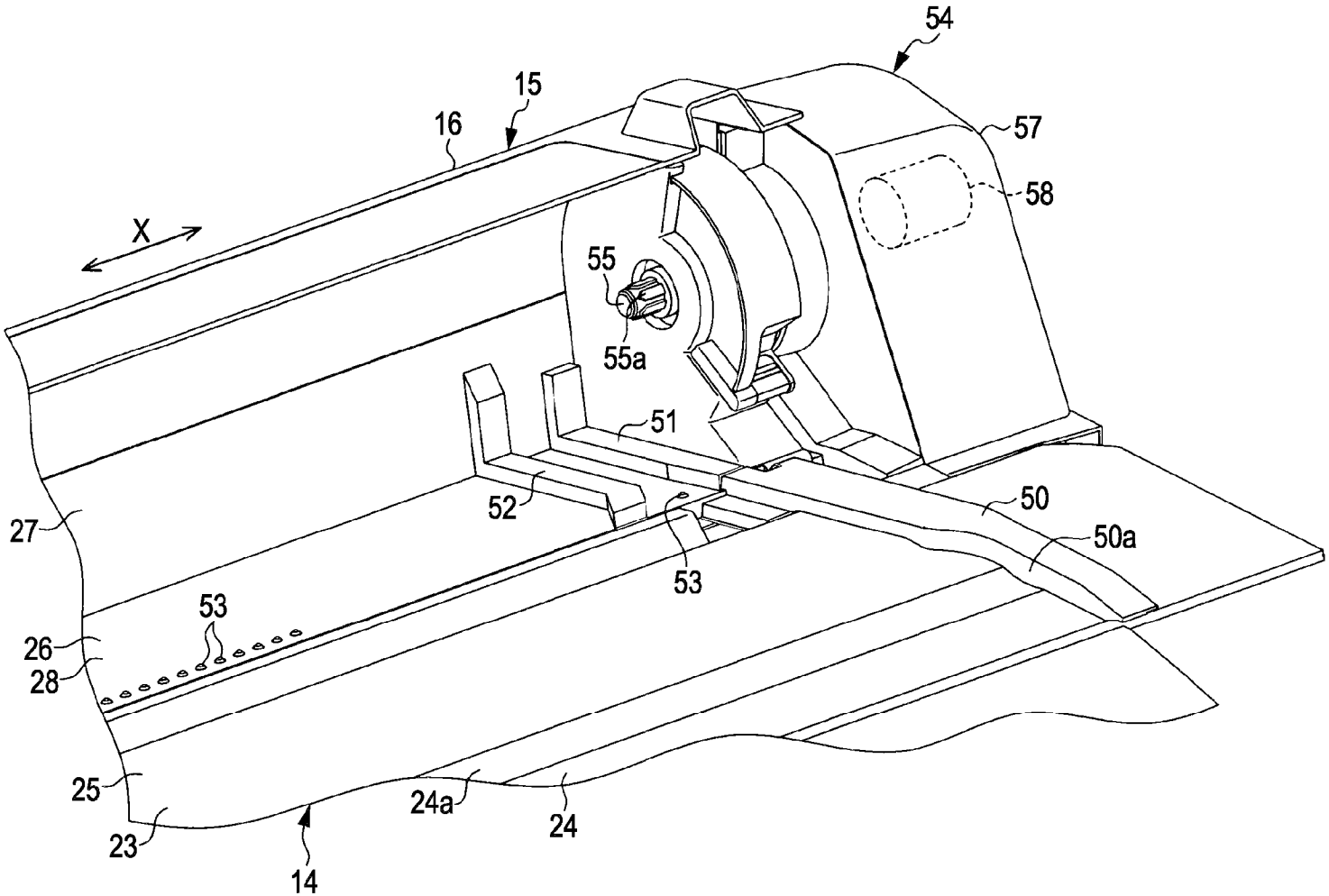
FIG. 7 is an enlarged perspective view illustrating a state in which an operation lever in FIG. 6 is down.

As illustrated in FIG. 7, on a peripheral surface of the rotating shaft 55, plural engagement ribs 55*a* are provided at regular intervals in the circumferential direction. The rotating shaft 55 is caused to protrude to the protruding position when the roll paper RP (see FIG. 3) with the support units 30 attached thereto is loaded into the loading portion 28, whereby the rotating shaft 55 is inserted into the shaft hole 38 (see FIG. 5) of the shaft member 31. In this state, when the rotating shaft 55 is driven to be rotated, the engagement ribs 55*a* and the engagement pieces 39 (see FIG. 5) are engaged with each other in the rotating direction, and the rotating power is transmitted from the rotating shaft 55 to the shaft member 31.

In the present embodiment, a transfer path for transferring the roll paper RP with the support units 30 attached thereto from the temporary placement portion 24 to the loading portion 28 is composed of the top plate 23, the bottom plate 26 and the respective guide members 50, 51 and 52. Further, in the present embodiment, the medium loading device includes the paper feeder 15, the top plate 23, the support unit 30 and the respective guide members 50, 51 and 52.

Next, the operation of the ink jet type printer 11 will be explained below.

Figure 8:
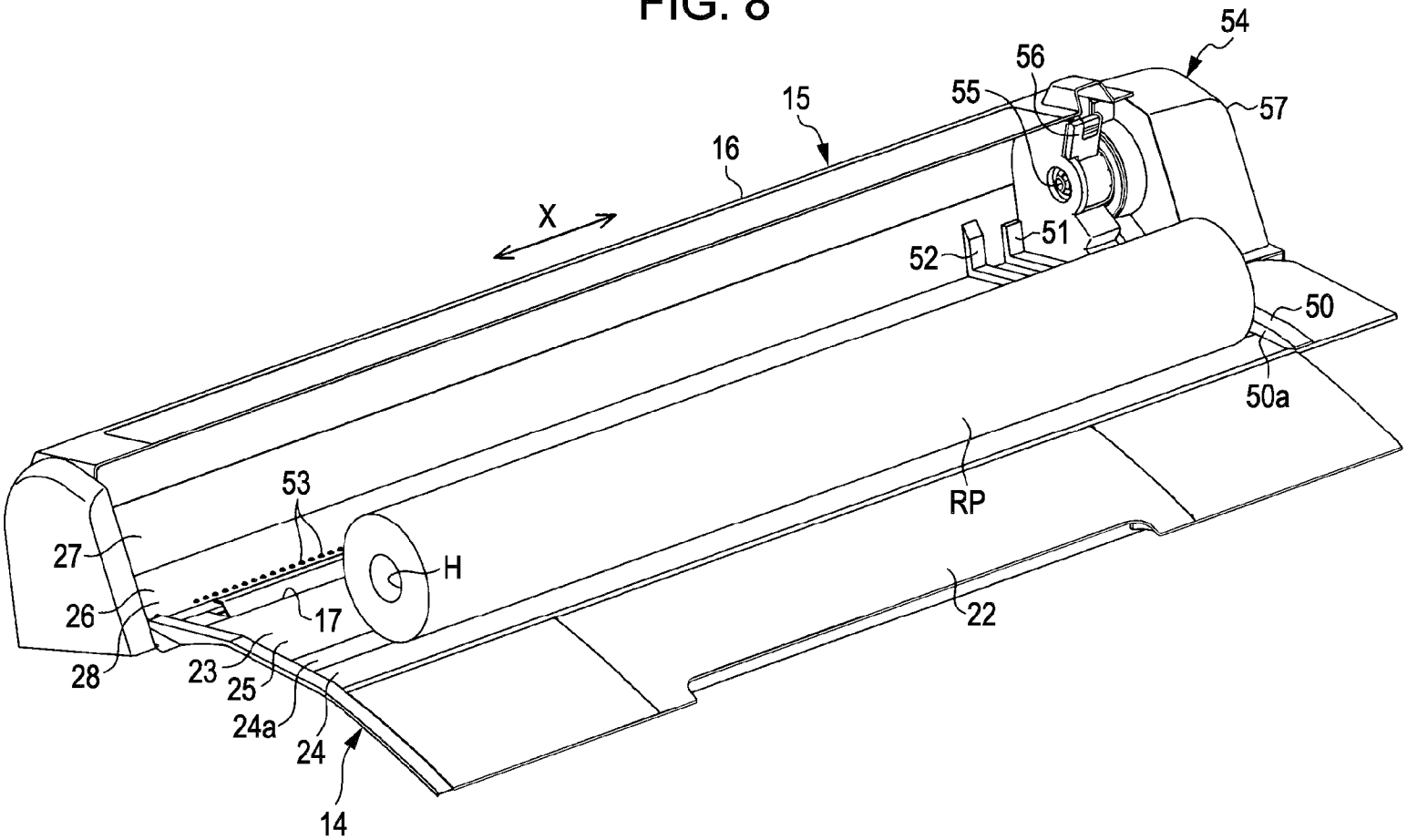
FIG. 8 is an enlarged perspective view illustrating a state in which the roll paper is placed on a temporary placement portion in FIG. 2.

For performing printing on the roll paper RP, in the state in which the access cover 16 is opened, the user places the roll paper RP on the positioning concave portion 24*a* of the temporary placement portion 24, as illustrated in FIG. 8. Then, since the roll paper RP is stable on the positioning concave portion 24*a*, rotation of the roll paper RP is suppressed.

Figure 9:
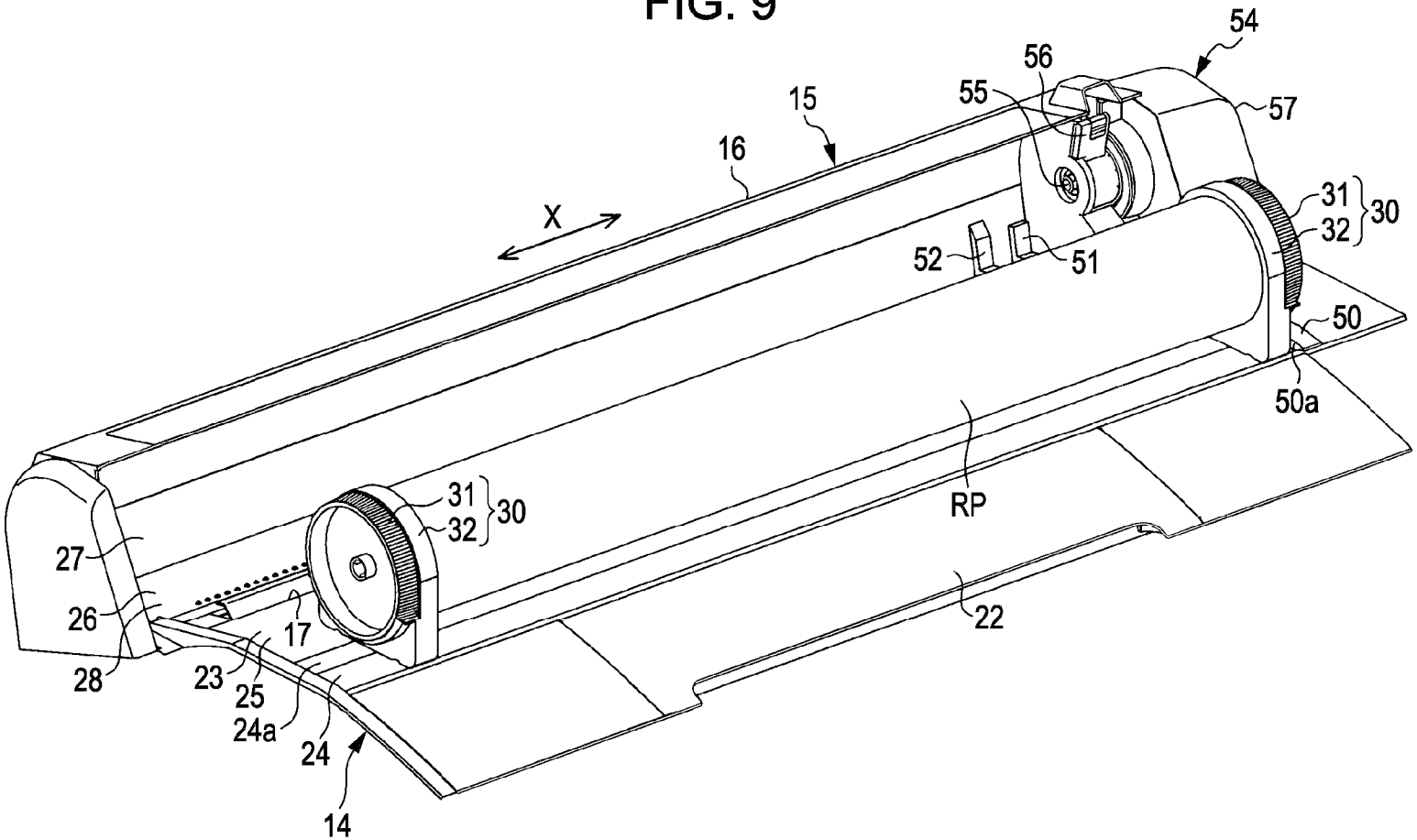
FIG. 9 is a perspective view illustrating a state in which the support units are attached to the roll paper in FIG. 8.

Subsequently, as illustrated in FIG. 9, the shaft portion 37 (see FIG. 4) of the shaft member 31 in each support unit 30 is inserted from each of both sides of the roll paper RP into the center hole H (see FIG. 8) by the user, whereby the support units 30 are attached to both end sections of the roll paper RP.

At this time, the first guide member 50 might be obstructive; when attaching the support unit 30 to the end section of the roll paper RP on the first guide member 50 side. However, the first guide member 50 has the clearance 50*a*, and therefore, is not particularly obstructive. After attaching the support units 30 to the both end sections of the roll paper RP, the roll paper RP is supported by the support units 30 without contacting the temporary placement portion 24.

Figure 10:
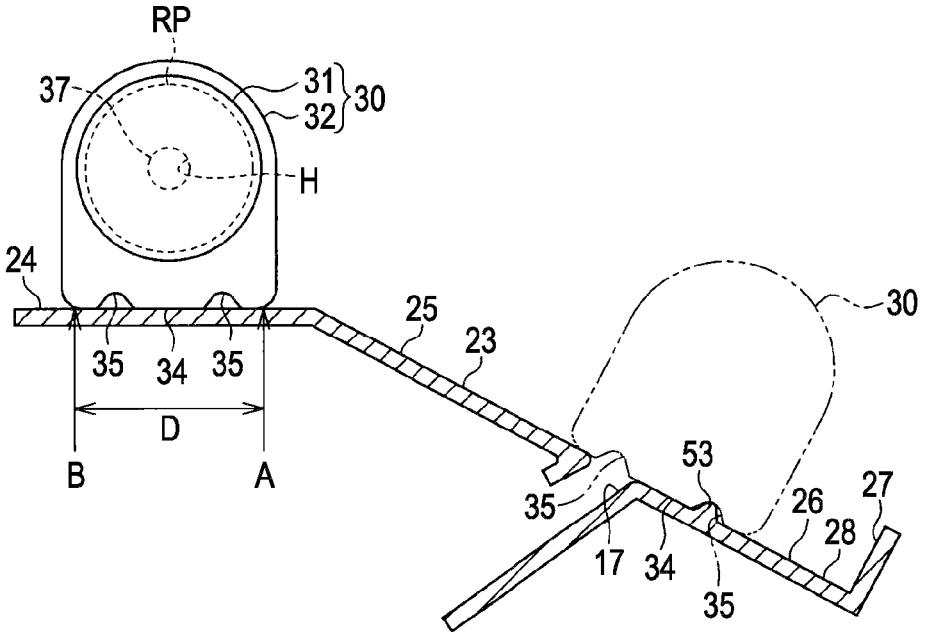
FIG. 10 is a schematic cross-sectional view illustrating a state in which the roll paper with the support units attached thereto is transferred from the temporary placement portion to a loading portion.

At this time, as illustrated in FIG. 10, the flat surface 34 of the flange member 32 in each support unit 30, which is a region facing the top plate 23, is in contact with the top plate 23. In this case, a point where the flat surface 34 is in contact with the top plate 23 and is closest to the loading portion 28 is denoted as a first contact point A. A point where the flat surface 34 is in contact with the top plate 23 and is closest to the temporary placement portion 24 is denoted as a second contact point B. The first contact point A and the second contact point B are disposed at a certain distance D from each other.

In this case, the distance D is larger than the outer diameter of the roll paper RP, and the center of gravity of the roll paper RP is positioned between the first contact point A and the second contact point B. Therefore, the roll paper RP is supported by the support units 30 significantly stably above the temporary placement portion 24. Subsequently, the user presses, by hand, the roll paper RP with the support units 30 attached to its end portions, in other words, presses the support units 30 that support the roll paper RP, from the temporary placement portion 24 to the loading portion 28 side.

Then, since the flat surface 34 of the flange member 32 in each support unit 30 is in contact with the top plate 23 that forms the transfer path, the support units 30 that support the roll paper RP slides. That is, the support units 30 that support the roll paper RP slide downward on the inclined portion 25 toward the loading portion 28, while the roll paper RP is not being rotated.

At this time, the support unit 30 on the first guide member 50 side is led by the first guide member 50 toward a region between the second guide member 51 and the third guide member 52 in the loading portion 28. When a front end section of each support unit 30 in its transfer direction comes into contact with the loading portion 28, the flange members 32 in the support units 30 climb over the protrusions 53, and then, the protrusions 53 fit with a play into the concave grooves 35 of the flange members 32 on a front side in the transfer direction, as illustrated in FIG. 10.

At this time, since a shock is applied to each support unit 30 by each protrusion 53, each protrusion 53 functions as a shock applier that applies a shock to each support unit 30. By feeling this shock by hand, the user recognizes that the protrusions 53 fit with a play into the concave grooves 35 of the flange members 32 on the front side in the transfer direction.

Figure 11:
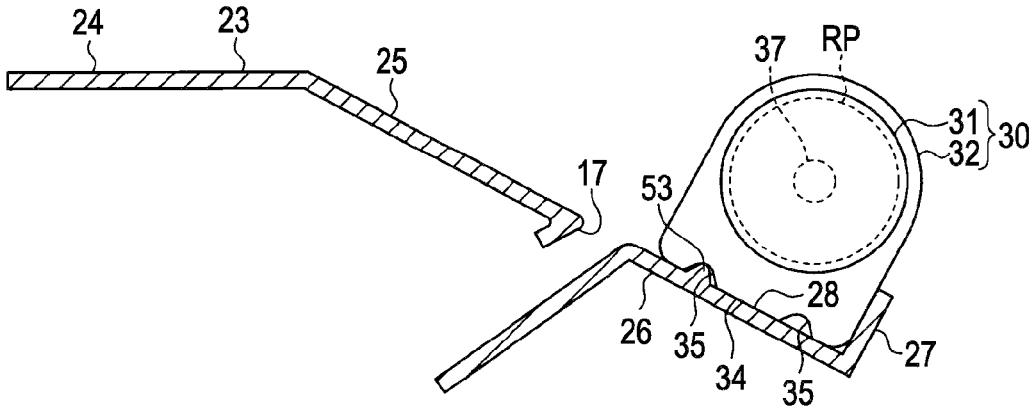
FIG. 11 is a schematic cross-sectional view illustrating a state in which the roll paper with the support units attached thereto is loaded into the loading portion.

Subsequently, when the user presses each support unit 30 further toward the loading portion 28 side, the flange members 32 in the support units 30 climb over the protrusions 53, thereafter, the protrusions 53 fit with a play into the concave grooves 35 of the flange member 32 on a rear side in the transfer direction, and the surface of each flange member 32 on the front side in the transfer direction comes in contact with the back-side plate 27, as illustrated in FIG. 11. That is, the roll paper RP is loaded into the loading portion 28 in a state in which the roll paper RP is supported by the support units 30.

Figure 12:
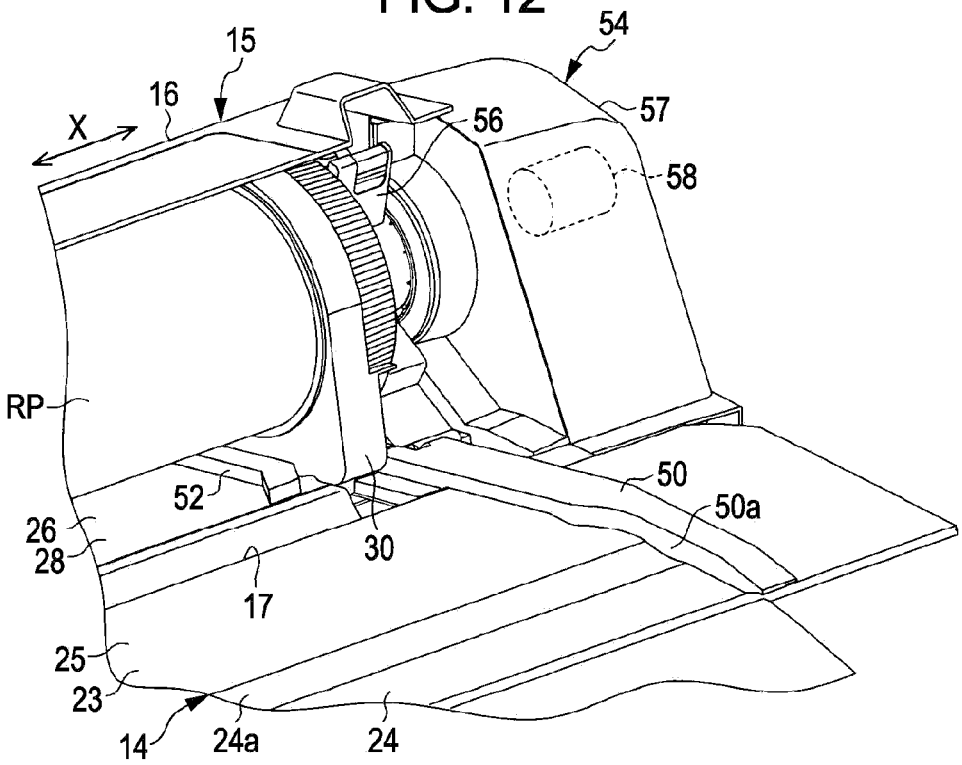
FIG. 12 is a perspective view illustrating the state in which the roll paper with the support units attached thereto is loaded into the loading portion in FIG. 6.

At this time, as illustrated in FIG. 12, the support unit 30 on the first guide member 50 side is led by the second guide member 51 and the third guide member 52 to be inserted between the second guide member 51 and the third guide member 52 in the loading portion 28. Therefore, the second guide member 51 and the third guide member 52 determine a position of the support unit 30 on the first guide member 50 side in the scanning direction X, and accordingly determine a position of the roll paper RP in the scanning direction X.

Further, at this time, a shock is applied to each support unit 30 by each protrusion 53. By feeling this shock through his or her hand, the user recognizes that the roll paper RP with the support units 30 attached thereto has been loaded into the loading portion 28.

As described above, the roll paper RP with the support units 30 attached thereto is not rotated in the course of transferring the roll paper RP from the temporary placement portion 24 to the loading portion 28. Thus, the roll paper RP is transferred stably from the temporary placement portion 24 to the loading portion 28.

Further, in a state in which the roll paper RP with the support units 30 attached thereto is loaded into the loading portion 28, the shaft hole 38 of the shaft member 31 in the support unit 30 on the first guide member 50 side and the rotating shaft 55 face each other in the scanning direction X.

Figure 13:
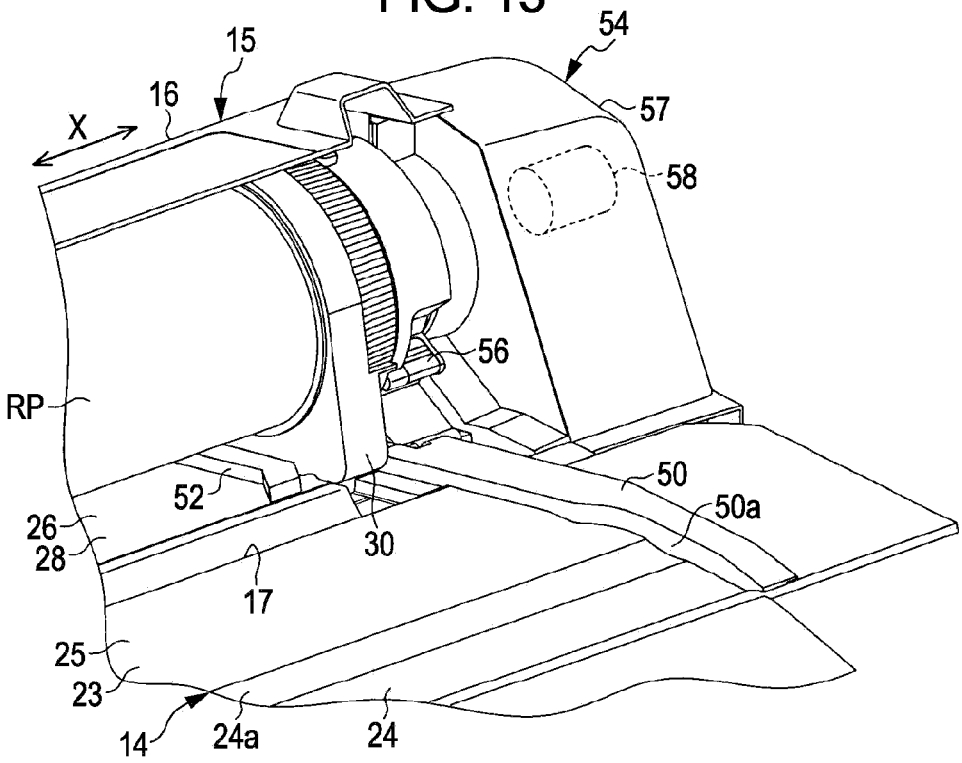
FIG. 13 is a perspective view illustrating a state in which the operation lever in FIG. 12 is down.

In this state, when flipping down the operation lever 56 as illustrated in FIG. 13, the rotating shaft 55 protrudes to its projecting position, and is inserted into the shaft hole 38 of the shaft member 31 in the support unit 30 on the first guide member 50 side. Subsequently, the paper P unwound and drawn out from the roll paper RP is inserted through the paper feeding slot 17 into the main body 14 along its transport path.

When the user closes the access cover 16 and subsequently operates the operation panel 21 to start printing, the rotating shaft 55 is driven to be rotated by the motor 58, and the rotating power of this rotating shaft 55 is transmitted via the shaft member 31 to the roll paper RP.

Then, the shaft member 31 and the roll paper RP are rotated together in the direction in which the paper P is drawn from the roll paper RP. The paper P drawn out from the roll paper RP is printed by ink that is ejected from the recording head 20 in the course of moving the paper P along the transport path in the main body 14. Thereafter, the paper P is ejected from the paper ejecting slot 18.

According to the above-described embodiment, following effects can be obtained.

(1) The first contact point A where the flat surface 34 of the flange member 32 in each support unit 30 is in contact with the top plate 23 and is closest to the loading portion 28, and the second contact point B where the flat surface 34 is in contact with the top plate 23 and is closest to the temporary placement portion 24 are disposed at a certain distance D from each other. Thus, the roll paper RP with the support units 30 attached thereto can slide from the temporary placement portion 24 to the loading portion 28 via the top plate 23 (the transfer path). That is, the roll paper RP can be transferred from the temporary placement portion 24 to the loading portion 28, while the roll paper RP is not rotating. Accordingly, the roll paper RP placed on the temporary placement portion 24 can be transferred stably to the loading portion 28.

(2) The temporary placement portion 24 is horizontal, the loading portion 28 is positioned lower than the temporary placement portion 24, and the inclined portion 25 that forms the transfer path from the temporary placement portion 24 to the loading portion 28 slopes downward from the temporary placement portion 24 to the loading portion 28. Thus, the roll paper RP with the support units 30 attached thereto can be placed stably on the temporary placement portion 24, and then, the support units 30 that support the roll paper RP can slide easily from the temporary placement portion 24 to the loading portion 28 via the inclined portion 25 by gravity.

(3) Since the center of gravity of the roll paper RP is positioned between the first contact point A and the second contact point B, the roll paper RP can be supported stably by the support units 30.

(4) Since the distance D between the first contact point A and the second contact point B is larger than the outer diameter of the roll paper RP, the roll paper RP can be supported more stably by the support units 30.

(5) On the bottom plate 26 that structures the transfer path, the protrusions 53, which apply a shock to the support units 30 when the roll paper RP with the support units 30 attached thereto slides to the loading portion 28, are provided. Thus, when the roll paper RP with the support units 30 attached thereto slides to the loading portion 28 by the user, a shock can be applied to the support units 30 by the protrusions 53. Therefore, by making the user feel this shock, the user can recognize that the roll paper RP with the support units 30 attached thereto has been loaded into the loading portion 28.

Modified Example

The above-described embodiment can be modified as follows.

Figure 14:
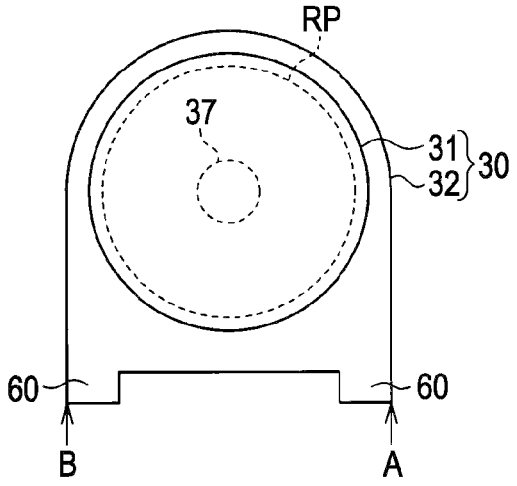
FIG. 14 is a schematic lateral view of the support unit in a modified example.

As illustrated in FIG. 14, instead of the plane surface 34, block-shaped convex portions 60 may be provided to both end sections of the region facing the transfer path in the flange member 32 in the support unit 30, whereby each convex portion 60 may function as a contact portion which is in contact with the transfer path. In this case, the first contact point A and the second contact point B are also disposed at a certain distance from each other.

Figure 15:
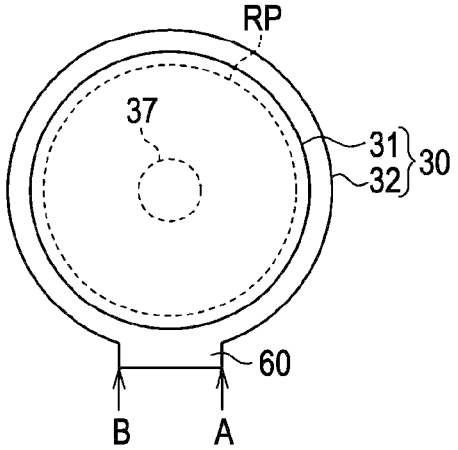
FIG. 15 is a schematic lateral view of the support unit in a modified example.

As illustrated in FIG. 15, the flange member 32 in the support unit 30 may be circular, and instead of the flat surface 34, one block-shaped convex portion 60 may be provided at a center section of the region facing the transfer path in the flange member 32, whereby the convex portion 60 may function as a contact portion that is in contact with the transfer path. In this case, the first contact point A and the second contact point B are disposed at a certain distance from each other.

Figure 16:
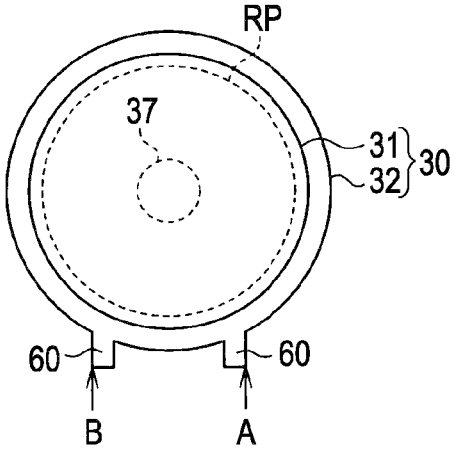
FIG. 16 is a schematic lateral view of the support unit in a modified example.

As illustrated in FIG. 16, the flange member 32 in the support unit 30 may be circular, and instead of the flat surface 34, block-shaped convex portions 60 may be provided to both end sections of the region facing the transfer path in the flange member 32 in the support unit 30, whereby each convex portion 60 may function as a contact portion that is in contact with the transfer path. In this case, the first contact point A and the second contact point B are also disposed at a certain distance from each other.

Figure 17:
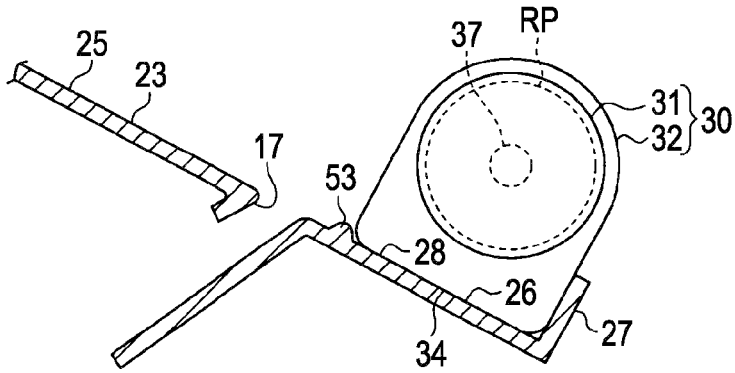
FIG. 17 is a schematic cross-sectional view illustrating a state in which the roll paper with the support units attached thereto is loaded into the loading portion in a modified example.

As illustrated in FIG. 17, each concave groove 35 may be omitted in the flange member 32 in the support unit 30. In this case, in the state in which the roll paper RP with the support units 30 attached thereto is loaded into the loading portion 28, each protrusion 53 is positioned more closely to the top plate than each support unit 30.

Figure 18:
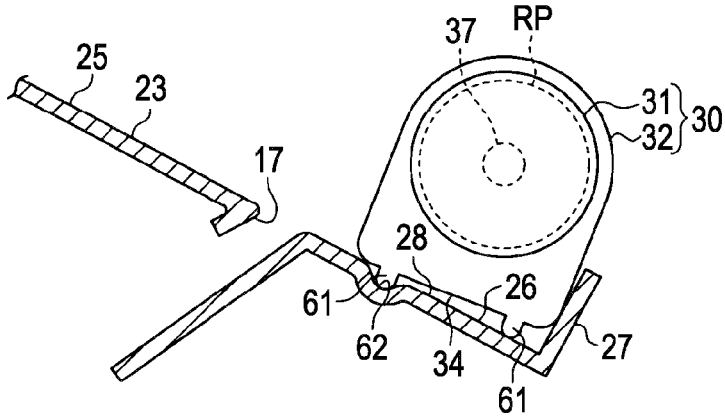
FIG. 18 is a schematic cross-sectional view illustrating a state in which the roll paper with the support units attached thereto is loaded into the loading portion in a modified example.

As illustrated in FIG. 18, in the flange member 32 in the support unit 30, a protruding portion 61 may be provided instead of the concave groove 35. Also, on the bottom plate 26, a concave portion 62 into which each protruding portion 61 is fit with a play may be provided as the shock applier instead of the protrusion 53.

On the bottom plate 26, the protrusions 53 may be omitted.

The distance D between the first contact point A and the second contact point B is not necessarily larger than the outer diameter of the roll paper RP.

The center of gravity of the roll paper RP is not necessarily positioned between the first contact point A and the second contact point B.

The temporary placement portion 24 is not necessarily horizontal. That is, the temporary placement portion 24 may slope.

The loading portion 28 is not necessarily positioned lower than the temporary placement portion 24. That is, the loading portion 28 may be positioned at the same level as the temporary placement portion 24 or higher than the temporary placement portion 24. In this case, the inclined portion 25 is horizontal or slopes up toward the loading portion 28.

Instead of the roll paper RP, plastic film, cloth, foil or the like may be used as the roll medium.

In the above-described embodiment, the recording apparatus may be a fluid ejecting apparatus that performs recording by ejecting or emitting fluid other than ink (the fluid includes liquid, a liquid-state substance obtained by dispersing or mixing particles of a functional material into liquid, a fluid-state substance such as a gel, and a solid that can flow and be ejected as a fluid). The recording apparatus may be, for example, a liquid-state substance ejecting apparatus that performs recording by ejecting a liquid-state substance containing a material such as an electrode material and a coloring material (a pixel material) in the form of a dispersion or dissolution. Such a material is used for manufacturing a liquid-crystal display, an electroluminescence (EL) display, a surface-emitting display and the like. Moreover, the recording apparatus may be a fluid-state substance ejecting apparatus that ejects a fluid-state substance such as a gel (for example, physical gel). The invention can be applied to any one kind of these fluid ejecting apparatuses. Note that "fluid" in the present specification does not conceptionally include a fluid that is made solely of gas, but includes, for example, a liquid (including inorganic solvent, organic solvent, solution, liquid resin, liquid metal (metallic melt) and the like), a liquid-state substance, a fluid-state substance and the like.

The entire disclosure of Japanese Patent Application No. 2012-92677, filed Apr. 16, 2012 is expressly incorporated by reference herein.

What is claimed is:

1. A medium loading device comprising:

at least one support unit;

wherein the at least one support unit comprises, a medium holder capable of attaching to an end sections of a roll medium so that the medium holder is rotatable together with the roll medium, and a medium supporter that rotatably supports the medium holder;

a loading portion in which the at least one support units, having a roll medium attached thereto, is loaded;

a temporary placement portion on which the at least one support units, having a roll medium attached thereto, is placed temporarily before being loaded into the loading portion; and a transfer path for transferring the at least one support unit, having a roll medium attached thereto, from the temporary placement portion to the loading portion, wherein the medium supporter has a lower surface that faces the transfer path, the lower surface includes a contact portion that is in contact with the transfer path, and the contact portion has a first contact point which is in contact with the transfer path and is closest to a proximate end of the medium supporter; and a second contact point which is in contact with the transfer path and is closest to a distal end of the medium supporter, and at least one concave groove disposed between, and separating, the first contact point and the second contact point.

2. The medium loading device according to claim 1, wherein the temporary placement portion is horizontal and is positioned lower than the loading portion, and the transfer path slopes.

3. A recording apparatus comprising:

the medium loading device according to claim 2; and a recorder that performs recording processing on the roll medium which is drawn out from the medium loading device.

4. The medium loading device according to claim 1, wherein a center of gravity of the roll medium is positioned between the first contact point and the second contact point.

5. A recording apparatus comprising:

the medium loading device according to claim 4; and a recorder that performs recording processing on the roll medium which is drawn out from the medium loading device.

6. The medium loading device according to claim 1, wherein the distance between the first contact point and the second contact point is larger than an outer diameter of the roll medium.

7. A recording apparatus comprising:

the medium loading device according to claim 6; and a recorder that performs recording processing on the roll medium which is drawn out from the medium loading device.

8. The medium loading device according to claim 1, wherein the transfer path is provided with a shock applier that applies a shock to the at least one support unit when the roll medium with the support units attached thereto is transferred to the loading portion.

9. A recording apparatus comprising:

the medium loading device according to claim 8; and a recorder that performs recording processing on the roll medium which is drawn out from the medium loading device.

10. A recording apparatus comprising:

the medium loading device according to claim 1; and a recorder that performs recording processing on the roll medium which is drawn out from the medium loading device.

* * * * *